United States Patent [19]

Huston

[11] Patent Number: 5,063,993

[45] Date of Patent: Nov. 12, 1991

[54] AIR HEATER WITH AUTOMATIC SEALING

[75] Inventor: Douglas A. Huston, North Canton, Ohio

[73] Assignee: The Babcock & Wilcox Company, New Orleans, La.

[21] Appl. No.: 693,189

[22] Filed: Apr. 29, 1991

Related U.S. Application Data

[62] Division of Ser. No. 602,440, Oct. 22, 1990.

[51] Int. Cl.[5] ..... F28D 17/04

[52] U.S. Cl. ..... 165/4; 165/9

[58] Field of Search ..... 165/4, 9

[56] References Cited

U.S. PATENT DOCUMENTS

| | | | |
|---|---|---|---|
| 2,471,995 | 4/1949 | Yerrick et al. . | |
| 2,765,150 | 7/1956 | Persson et al. . | |
| 2,852,234 | 8/1958 | Mudersbach . | |
| 2,951,686 | 9/1960 | Sandmann et al. | 165/4 |
| 3,232,335 | 10/1966 | Kalbfleisch . | |
| 3,246,686 | 8/1966 | Kalbfleisch et al. . | |
| 3,250,316 | 11/1966 | Nyberg . | |
| 3,321,010 | 8/1967 | Brandt et al. . | |
| 3,344,849 | 9/1967 | Firgau et al. . | |
| 3,373,797 | 7/1968 | Nyberg . | |
| 3,404,727 | 11/1968 | Mock . | |
| 3,786,868 | 10/1974 | Finnemore . | |
| 3,822,739 | 3/1974 | Kurschner . | |
| 4,000,774 | 3/1977 | Puritz et al. . | |
| 4,024,907 | 9/1977 | Brzytwa . | |
| 4,058,158 | 10/1977 | Blom et al. . | |
| 4,114,680 | 4/1978 | Kritzler et al. . | |
| 4,122,891 | 2/1978 | Baker . | |
| 4,124,063 | 4/1978 | Stockman . | |
| 4,149,587 | 10/1979 | Stockman . | |
| 4,206,803 | 5/1980 | Finnemore et al. . | |
| 4,301,858 | 1/1981 | Mock . | |
| 4,421,157 | 4/1983 | Sandmann . | |
| 4,610,297 | 7/1986 | Gibson et al. . | |
| 4,669,531 | 1/1987 | Conde . | |
| 4,760,875 | 11/1988 | Gibson et al. . | |

FOREIGN PATENT DOCUMENTS

| | | | |
|---|---|---|---|
| 20087 | 2/1985 | Japan . | |
| 2143629 | 2/1985 | United Kingdom | 165/9 |

OTHER PUBLICATIONS

Babcock & Wilcox Technical Paper-Br-1384-"Operation and Evaluation of Rothemuhle Regenerative Air Heater Automatic Cold-end Sealing System"-Hart & Huston-Presented to: Association of Rural Electric Generating Cooperatives-Summer Conference-Bismarck, N.D.-Jun. 18-21, 1989-Entire Document.

*Primary Examiner*—Albert W. Davis, Jr.
*Attorney, Agent, or Firm*—Vytas R. Matas; Robert J. Edwards; Eric Marich

[57] ABSTRACT

A sealing arrangement for a regenerative air heater having a stator with a peripheral flange and hot and cold end hoods mounted for rotation over respective opposite surfaces of the stator, includes a seal frame which is connected to the cold end hood over an expansion joint assembly. A plurality of cast iron seal shoes are connected to the frame and positioned at selected gaps from the stator flange. A wheel rotatably mounted to the frame near each seal shoe rolls against the stator flange to maintain the selected gap while a counter weight on a lever acts to urge the seal shoes toward the flange. The arrangement is automatic in its maintenance of the selected gap.

6 Claims, 7 Drawing Sheets

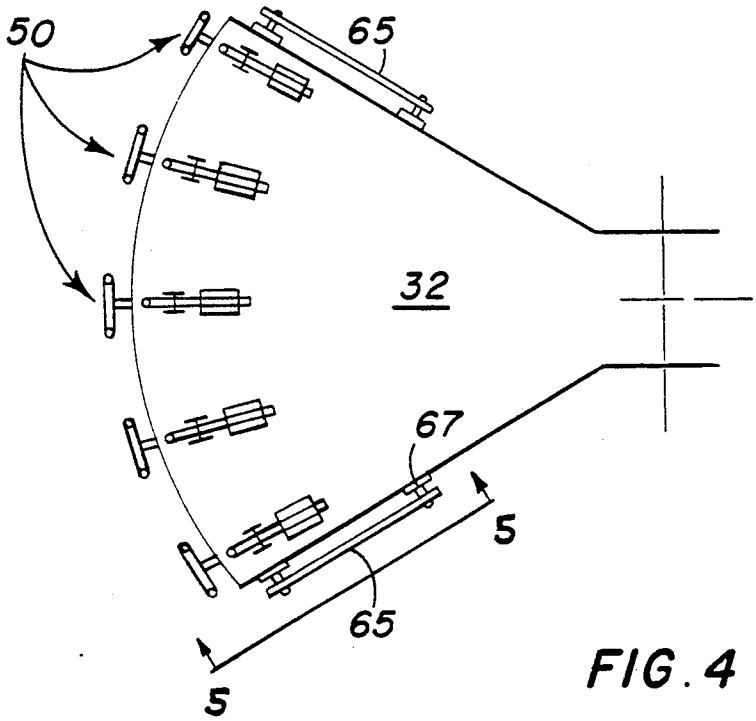
FIG. 4
FIG. 5
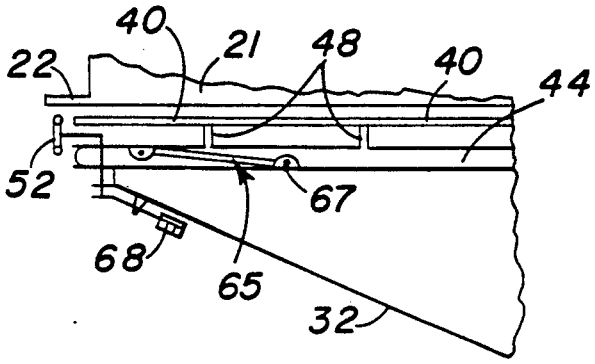

AIR HEATER WITH AUTOMATIC SEALING

This is a division of application Ser. No. 602,440, filed Oct. 22, 1990.

FIELD AND BACKGROUND OF THE INVENTION

The present invention relates in general to rotary regenerative air heaters for transferring waste heat from boiler flue gas to combustion air and, in particular, to a new and useful automatic mechanical cold end sealing system connected to air seals of a duct hood frame in the regenerative air heater.

In one type of rotary regenerative air heater, a cylindrical heat exchange mass and a containment structure, called the stator, are positioned stationary between the inlets and outlets of the air and gas ducts. The stator is a radially compartmented steel shell packed with a multiplicity of plates, arranged to provide an axial passage therethrough, such that the gas and air flow in an axial direction through the cylindrical heat exchange mass. The plates embody shapes, materials and thicknesses designed to provide optimum heat transfer, low pressure drop, resistance to corrosion, and ease of cleaning.

Air ducts at each axial end of the stator include air duct hoods, co-axially aligned with the cylindrical heat exchange mass, which are secured to a central drive shaft for co-axial rotation in relation to the cylindrical heat exchange mass. Each of the air duct hoods comprises a respective central flow inlet or outlet passage centrally mounted between, and in fluid communication with, two diametrically opposite hood segments or sectors for the passage of air to or from the heating mass. The hood segments of each of the air duct hoods are generally pie-shaped and circumferentially spaced from each other.

The gas ducts are arranged stationary, also at the opposite ends of the stator, and surround the rotating air duct hoods.

The air duct hoods, at upper and lower ends of the heat exchange mass, rotate synchronously so that alternate radial sectors of the mass of plates are alternately exposed to a hot flue gas stream and then cooled by a combustion air stream thereby effecting a regenerative heating and cooling cycle.

Sealing between the stationary and rotating components is achieved by articulated seal frames which are spring mounted to the rotating air duct hoods. As the stator expands or contracts, the frames adapted to the stator's periphery in order to maintain an effective seal at various boiler loads. The seal frame, which extends along the peripheries of the hood segments adjacent the heat exchange mass, carries a sealing strip. The sealing strip is resiliently urged in close proximity to cylindrical and radial end surfaces of the stator. During rotation of the air duct hood, the sealing strip slides along the end surfaces in sealing relationship with the stator.

An expansion joint is connected between the seal frame and the air duct hood to accommodate relative thermal displacement.

U.S. Pat. No. 4,669,531 discloses such a rotary regenerative air heater.

Apparatebau Rothemuhle of Germany manufactures this type of regenerative air heater.

In the Rothmuhle type regenerative air heater, sealing at the hood-stator interface is maintained by use of replaceable cast iron seal shoes mounted on a structural steel seal frame which is connected to the hood by a single fold expansion joint. The seal frame is supported on the hood by a number of spring bolt assemblies at the hood perimeter. Radial portions of the seal frame are equipped with a number of hinged articulation joints which enable the seal frame to follow the curvature of the stator as it deforms during operation.

Rothmuhle type air heaters employ thermally activated devices on the hot hoods to automatically lower seal shoes as the stator distorts, thereby maintaining minimum seal gaps. The thermal devices are not used on cold end hoods because temperatures are too low for them to function effectively. Therefore, seal gaps on the cold hood are preset away from the stator in the cold condition by the amount of expected maximum stator distortion which occurs at full load.

FIG. 1 illustrates the cold condition for a regenerative air heater generally designated 20, which comprises a stator 21 which has not yet been deformed due to thermal stresses, a hot hood 31 and an opposite cold hood 32. The known thermal activated devices 33 are shown in place on the hot hood. FIG. 1 also illustrates the substantial preset gap 34 which occurs between the lower surface of the stator 21 and the upper sealing surface of the cold hood 32, in the cold condition.

FIG. 2 corresponds to FIG. 1 but illustrates the heater 20 in its hot condition. In this condition, the stator 21 has been thermally distorted by a stator distortion amount 35 which serves to move the lower surface of the stator 21 into closer association with the upper sealing surface of cold hood 32.

Rothemuhle has also developed an automatic cold end seal system which utilizes an electro-mechanical device to maintain a programmable seal gap setting throughout the boiler's normal operating range to reduce air heater leakage. Inductive sensors placed in a flange of the air heater sense seal gap magnitudes as the hoods rotate. Signals are sent to a control computer where they are evaluated and compared to a preprogrammed gap. Adjustments are made by a motor driven ramp which activates a contact lever arm on the rim of the cold hood, to raise or lower the seal frame and bring the gap into tolerance. This device has the disadvantage of being complex. It also relies on the use of sensors in a hostile environment. Failure of any one of the critical components would also lead to failure of the seal.

Other solutions for adjusting the seal gap in a regenerative heater have also been proposed over the years.

U.S. Pat. No. 3,232,335 discloses pneumatic, mechanical and magnetic systems for sensing and thereafter compensating for variations in the seal gap. U.S. Pat. No. 3,246,686 discloses an arrangement which utilizes a plurality of individually rolling elements mounted independently of each other and connected to a floating sealing plate. The wheels roll against an annular flange of a rotor, and vary the force applied to the floating sealing plate as a function of the rolling action. U.S. Pat. No. 3,344,849 utilizes a spring plus counter weight arrangement for varying the force applied to a seal plate in a regenerative heater. All of these proposals suffer from complexity and sensitivity to mechanical, pneumatic or electrical failure.

SUMMARY OF THE INVENTION

The present invention comprises a completely mechanical and automatic air heater cold end sealing system. The system functions to maintain a preset hood seal shoe to stator face gap during all conditions of air heater operation. The seal shoes are at all times kept in close proximity to a stator flange by force applied to the seal frame via counter weight devices. Wheels fitted to the seal frame, through which a portion of the counter weight force is transmitted, roll round the stator flange perimeter thereby maintaining a constant seal gap.

Accordingly, an object of the present invention is to provide a sealing arrangement for a regenerative air heater having a stator with a peripheral flange, and hot and cold end hoods mounted for rotation over respective opposite surfaces of the stator, the arrangement comprising a seal frame for extending adjacent at least part of the stator flange, an expansion joint assembly connected between the cold and hood and the seal frame for movably mounting the frame to the cold end hood, at least one seal shoe connected to the frame and positioned at a selected gap from the stator flange, at least one wheel mounted for rotation to the frame near the shoe, the wheel rolling against the flange for maintaining the selected gap, and biasing means connected between the cold end hood and the frame for biasing the shoe toward the flange in a direction tending to reduce the size of the selected gap.

A further object of the present invention is to provide a sealing arrangement which is simple in design, rugged in construction and economical to manufacture.

BRIEF DESCRIPTION OF THE DRAWINGS

In the drawings:

FIG. 5 is a side elevational view taken in the direction of arrows 5—5 of FIG. 4;

DESCRIPTION OF THE PREFERRED EMBODIMENTS

Figure 8:
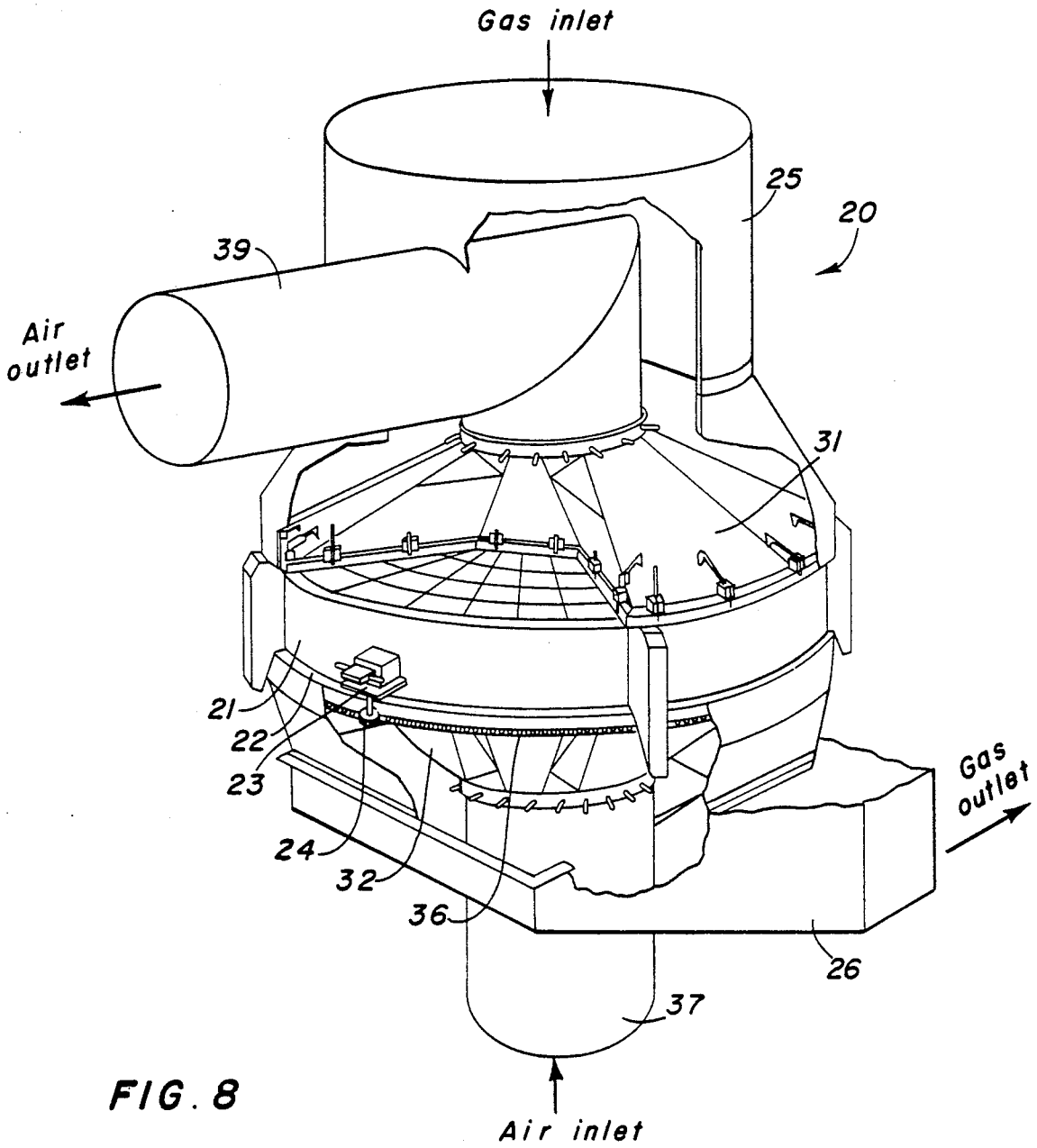
FIG. 8 is a side perspective view, with portions cut away, of a regenerative heater with which the present invention can be utilized.
Figure 9:
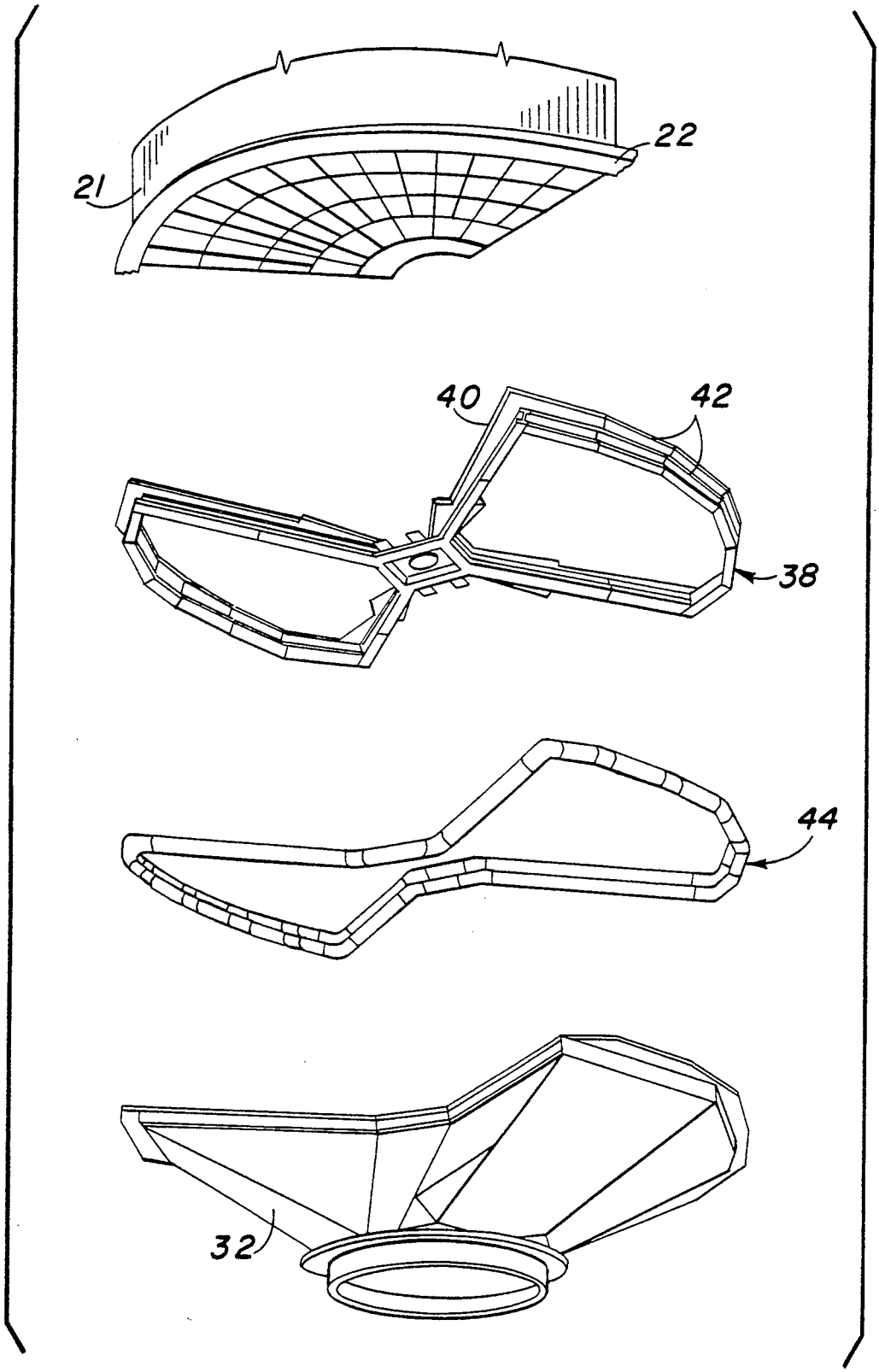
FIG. 9 is a perspective exploded view of the cold end hood with associated parts, with which the present invention can be utilized.

Referring to the drawings in particular, the invention embodied therein is utilized in a regenerative air heater shown in FIGS. 8 and 9. As illustrated in FIG. 8, the heater generally designated 20 comprises a fixed stator 21 having upper and lower surfaces for respectively receiving and discharging hot exhaust gas supplied by a hot gas inlet housing 25 and discharged by a cold gas outlet housing 26.

Upper hot end hood 31 and lower cold end hood 32 are connected to each other by an internal shaft (not shown) and, together, rotate over the respective opposite surfaces of the stator for supplying air to be heated through the stator. Rotation of the hoods is produced by a drive unit 23 mounted to the stator. Drive unit 23 rotates a pinion 24 which is meshed with a ring gear 36 fixed at the periphery of the cold end hood 32.

Air is provided to the cold end hood through an inlet duct 37 and is collected from the hot end hood 31 by an air outlet duct 39.

As best shown in FIG. 9, cold end hood 32 carries a seal frame 38 that extends along at least part of a peripheral flange 22 of the stator 21. An expansion joint assembly 44 connects the frame 38 to the hood 32 for movably mounting the frame to the hood.

The seal joint 38 carries a plurality of cast iron seal shoes 40 and 42. Seal shoes 40 extends radially across the gas exchange surface of the stator while peripheral seal shoes 42 extend adjacent, along and at a slight gap from the peripheral flange 22 of the stator 21.

Figure 1:
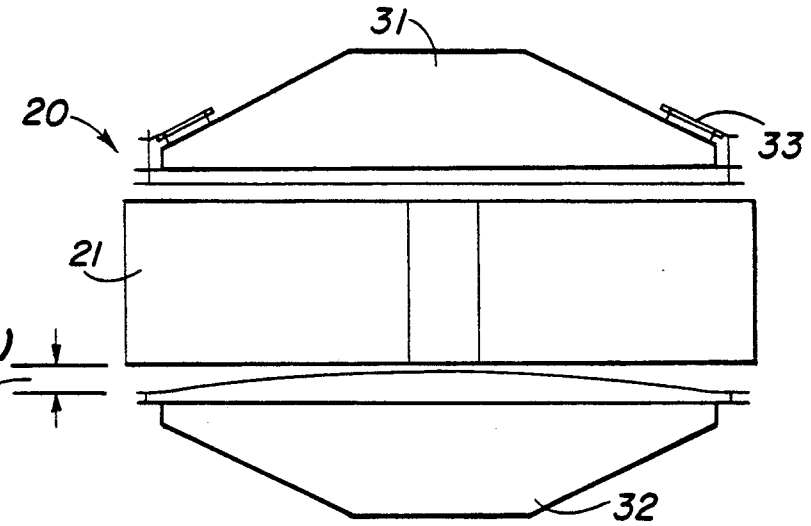
FIG. 1 (PRIOR ART)
FIG. 1 is a schematic and exaggerated side elevational view of a conventional regenerative air heater in its cold condition.
Figure 2:
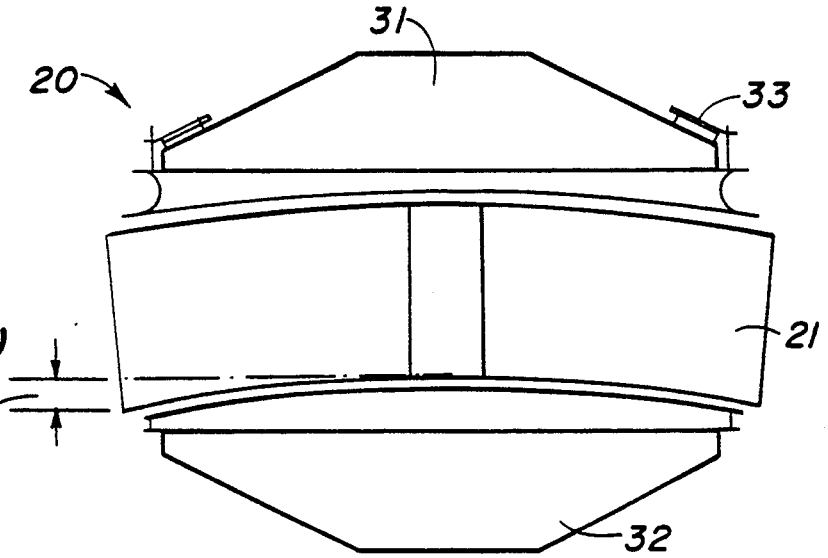
FIG. 2 (PRIOR ART)
FIG. 2 is a view similar to FIG. 1 of the heater in its hot condition.
Figure 3:
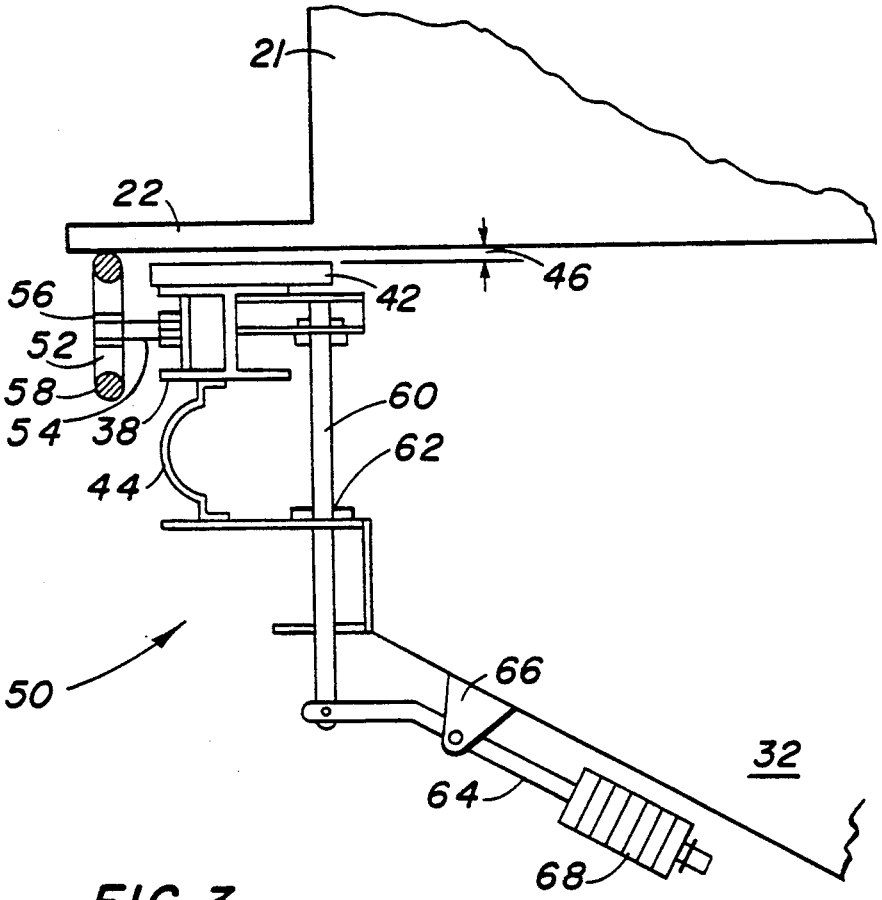
FIG. 3 is a side elevational view of a first embodiment of the invention; 4 is a partial, bottom plan view of the cold end hood showing the sealing arrangement of the invention installed.

Referring now to FIG. 3, a first embodiment of the present invention is a sealing arrangement generally designated 50 for the heater which is designed to mechanically and automatically maintain a selected gap 46 between the seal shoe 42 mounted on the seal frame 38, and the peripheral flange 22 of the stator 21.

To this end, a wheel 52 is mounted for rotation at a bearing 56 on a shaft 54 which is fixed to frame 38. Wheel 52 has a tire 58 with rolls against the under surface of flange 22 for maintaining a minimum size for gap 46.

To keep the seal shoe 42 from moving away from the flange 22, the invention also includes biasing means in the form of a bolt 60 fixed at this upper end to the frame 38, and slidably mounted through an opening 62 in a periphery of the cold end hood 32. Upward pressure is exerted on bolt 60 by a lever 64 pivotally mounted at a pivot bracket 66 to the outer surface of hood 32, and a counter weight 68.

Advantageously, wheel bearing 56 is sealed and lubricated to allow unattended operation for periods of 18 months in hot (400° F.) dusty flue gas environments. Tires 58 are replaceable and advantageously made of high temperature solid elastomeric material.

As best shown in FIGS. 4 and 5, proportional seal gap maintenance is achieved for the radial leg seal shoes 40 by a radial arm 65 which is pivotally mounted at one end to the outer-most radial seal shoe 40, and at an opposite end to a near mid-radial position 67 of the cold and hood 32. Hinges 48 interconnect the radial seal shoes 40, for transmitting forces from one seal shoe to the next, to maintain a proportional seal gap over the surface of the stator. As shown in FIG. 4, a plurality of the sealing arrangements 50 may be provided.

Figure 6:
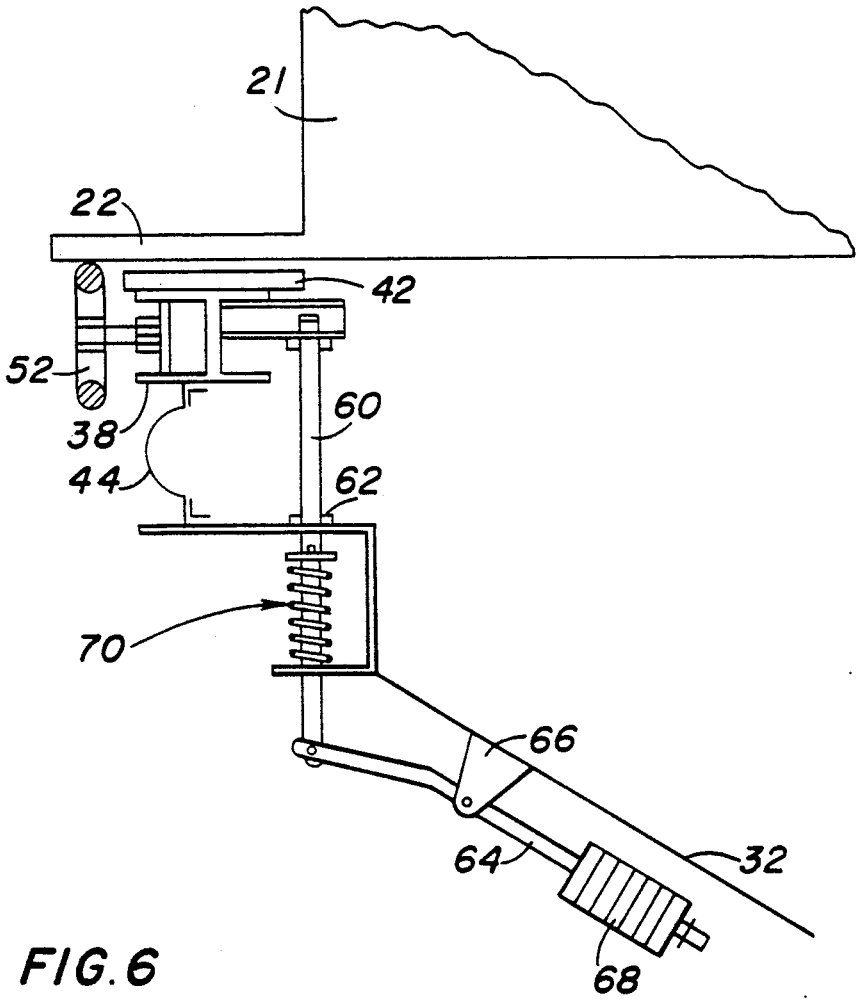
FIG. 6 is a view similar to FIG. 3 of a second embodiment of the invention.

FIG. 6 shows a second embodiment of the invention where, like in the remaining figures, the same reference numerals are utilized to designate the same or similar parts.

In FIG. 6, a spring 70 is engaged between the bolt 60 and the hood 32 for increasing the biasing force of the counter weight 68 in a direction to close the gap between the seal shoe 42 and the flange 22. Here again, the biasing force is counteracted by the wheel 52 rolling against the flange 22.

Figure 7:
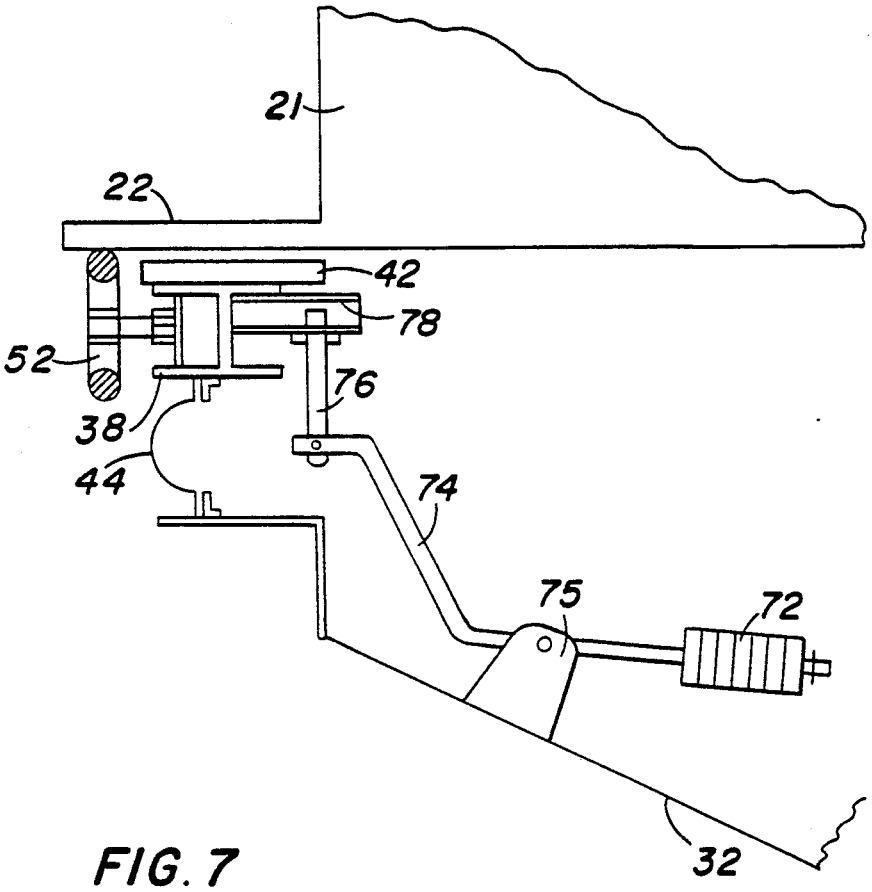
FIG. 7 is a view similar to FIG. 3 of a third embodiment of the invention.

FIG. 7 shows a third embodiment of the invention where the biasing means are mounted entirely internally of the hood 32 to avoid the small amount of gas leakage that would occur in the embodiments of FIGS. 3 and 6, through the opening 62 for slidably receiving the bolt 60.

In the embodiment of FIG. 7, counter weight 72 is connected to an inner end of lever 74 which is pivotally mounted at 75 to the inner surface of hood 32. The outer end of lever 74 is pivotally connected to a bolt 76 which, like in the embodiments of FIGS. 3 and 6, has an upper end fixed to a bracket 78, which in turn is fixed to frame 38. In this way, the upper biasing force on seal shoe 42 is established with a mechanical automatic mechanism that is internal of the hood 32.

What is claimed is:

1. A sealing arrangement for a regenerative air heater having a stator with a peripheral flange, and hot and cold end hoods mounted for rotation over respective opposite surfaces of the stator, the arrangement comprising:

a seal frame for extending adjacent at least part of the stator flange;

an expansion joint assembly connected between the cold end hood and the seal frame for movably mounting the seal frame to the cold end hood;

at least one seal shoe connected to the frame and positioned at a selected gap from the stator flange;

at least one wheel mounted for rotation to the frame and near the shoe, the wheel rolling along the flange for maintaining the selected gap; and biasing means connected between the cold end hood and the frame for urging the seal shoe toward the stator flange for reducing a size of the selected gap against the influence of the wheel for maintaining the selected gap, said biasing means including a lever pivotally mounted to an exterior surface of the cold end hood, a weight at one end of the lever, a bolt slidably mounted through an aperture in the cold end hood at an opposite end of the lever, connected between the lever and the frame, and a spring engaged between the bolt and the cold end hood for increasing the biasing force urging the seal shoe toward the stator flange.

2. An arrangement according to claim 1, wherein the at least one seal shoe comprises a peripheral seal shoe, at least one radial seal shoe operatively connected to the peripheral seal shoe and connected to the frame for extending radially along one of the opposite surfaces of the stator, and radial arm means connected between the radial seal shoe and the cold end hood for maintaining a proportional gap between the radial seal shoe and the surface of the stator, which is proportional to the selected gap between the peripheral seal shoe and the stator flange.

3. An arrangement according to claim 2, wherein said radial arm means comprises a radial arm having one end pivotally connected to the radial seal shoe and an opposite arm pivotally connected to the cold end hood.

4. An arrangement according to claim 3, wherein the opposite end of the radial arm is pivotally connected to the cold end hood near a radial midpoint of the cold end hood.

5. An arrangement according to claim 1, including a plurality of seal shoes connected to the seal frame, a plurality of wheels mounted for rotation to the frame, one wheel being mounted near each respective seal shoe, each wheel rolling against the stator flange for maintaining a selected gap between each seal shoe and the stator flange, and separate biasing means connected to the cold end hood for each seal shoe, said seal shoes being circumferentially spaced along the flange.

6. An arrangement according to claim 1, including a shaft connected to the frame, said wheel being rotatably mounted to the shaft on a sealed lubricated bearing, the wheel including a tire for rolling along the stator flange.

* * * * *